United States Patent [19]

Helm

[11] Patent Number: 4,492,186

[45] Date of Patent: Jan. 8, 1985

[54] STEAM GENERATOR SLUDGE REMOVAL METHOD

[75] Inventor: John L. Helm, Groton, Conn.

[73] Assignee: Proto-Power Management Corporation, Groton, Conn.

[21] Appl. No.: 410,562

[22] Filed: Aug. 23, 1982

[51] Int. Cl.[3] ..... F22B 37/54

[52] U.S. Cl. ..... 122/382; 165/95

[58] Field of Search ..... 122/382, 383, 390, 392, 122/379, 405; 15/318, 316 R; 165/95

[56] References Cited

U.S. PATENT DOCUMENTS

| | | | |
|---|---|---|---|
| 906,652 | 12/1908 | Nicholson et al. . | |
| 1,158,948 | 11/1915 | McLean . | |
| 1,696,005 | 12/1928 | Kothe . | |
| 3,915,122 | 10/1975 | Schroder . | |
| 4,037,569 | 7/1977 | Bennett et al. . | |
| 4,079,701 | 3/1978 | Hickman et al. | 122/382 |
| 4,276,856 | 7/1981 | Dent et al. . | |
| 4,407,236 | 10/1983 | Schukei | 122/382 X |

*Primary Examiner*—Edward G. Favors

*Attorney, Agent, or Firm*—Pasquale A. Razzano; Bernhard P. Molldrem, Jr.

[57] ABSTRACT

A method of removing sludge deposits from the tube plate of a steam generator of the type typically found in a nuclear electric generating plant involves inserting a jet lance into a handhole in the shell of the steam generator just above the tube sheet and along the tube lane, and inserting a flexible suction hose in that or another handhole. A jet nozzle on the lance is directed along one passageway defined by adjacent rows of tubes. The suction hose is adjusted until a suction opening at its end is aligned at the peripheral end of the one tube passageway. Then the sludge is jet blasted with a jet of cleaning fluid from the nozzle, and sufficient suction is applied to the hose so that all of the fluid and entrained sludge is sucked up as it issues from the peripheral end of the tube passageway.

14 Claims, 7 Drawing Figures

FIG. 3
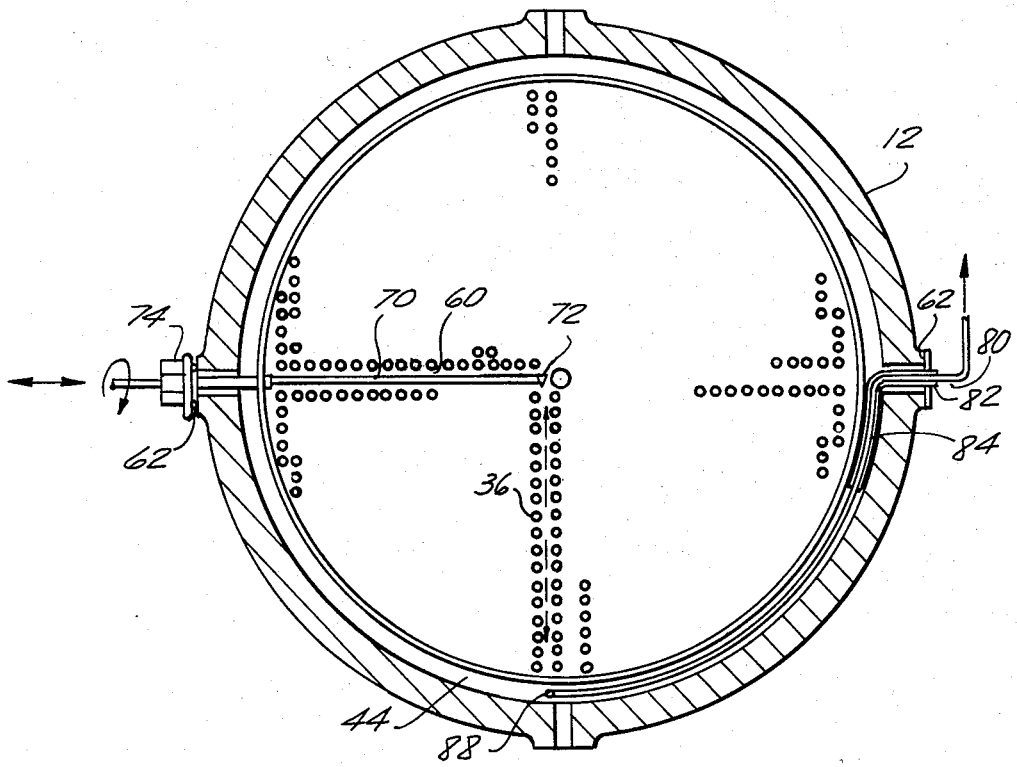
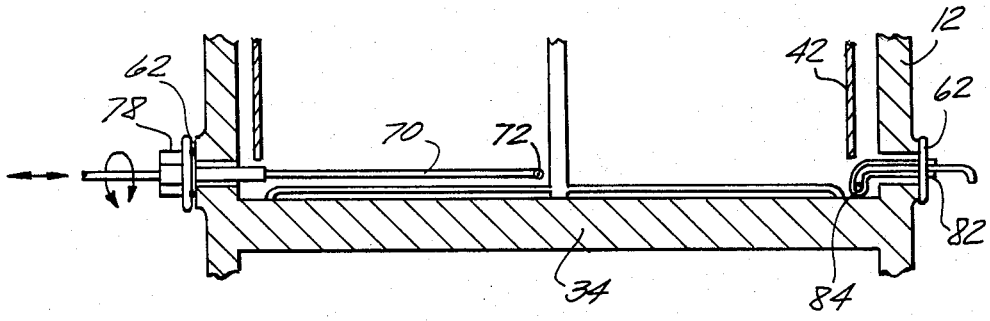
FIG. 4

STEAM GENERATOR SLUDGE REMOVAL METHOD

BACKGROUND OF THE INVENTION

This invention relates to the cleaning of steam generators, and is more particularly directed to a method of removing sludge deposits from the tube sheet of a steam generator.

A typical steam generator for use in a nuclear electrical generating plant is formed of a vertically-oriented cylindrical shell, a plurality of primary-fluid tubes disposed in the shell so as to form a tube bundle, and a substantially horizontal tube sheet for supporting the tubes so that the tube bundle rises therefrom within the shell.

While the generator can be either a once-through or a U-tube type generator, the method of this invention will be illustrated with the U-tube type generator.

A dividing plate cooperates with the tube sheet to form a primary fluid header at one side of the tube bundle and a primary fluid outlet header at the other side of the tube bundle. A primary fluid inlet nozzle is in fluid communication with the primary fluid inlet header and a primary fluid outlet nozzle is in fluid communication with the primary fluid outlet header. The steam generator also comprises a wrapper disposed between the tube bundle and the shell to form an annular chamber adjacent the shell, and a feedwater ring is disposed above the pipe-bend end of the tube bundle.

A primary fluid which has been heated by circulation through the core of a nuclear reactor enters the steam generator through the primary fluid inlet nozzle, and is conducted through the primary fluid inlet header, through the U-tube bundle, out the primary fluid outlet header and through the primary fluid outlet nozzle to a reactor coolant system. At the same time, feed water is introduced to the steam generator through the feedwater ring. The feed water is conducted down the annular chamber adjacent to shell until the tube sheet near the bottom of the chamber causes the feed water to reverse direction passing in heat-transfer relationship with the outside of the U-types, and up through the inside of the wrapper. While the feed water is circulating in heat transfer relationship with the tube bundle, heat is transferred from the primary fluid in the tubes to the feed water surrounding the tubes, causing a portion of the feedwater to be converted to steam. The steam then rises and is circulated through typical electrical generating equipment.

Because the primary fluid contains radioactive particles, it is of utmost importance to maintain complete isolation between the primary fluid and the feed water. However, the primary fluid is isolated from the feed water only by the walls of the tubes, which are typically constructed from Inconel. It is necessary that the tubes be maintained free of defects so that no breaks will occur in the tube walls. However, under certain conditions, the U-tubes may develop leaks which allow radioactive particles to contaminate the feed water.

There are thought to be at least two causes of such tube leaks in steam generators: one cause being high caustic levels in the vicinity of the tube sheet, and the other cause being tube thinning, also in the vicinity of the tube sheet. Both of the foregoing are associated with sludge that has accumulated on the tube sheet. This sludge is mainly composed of iron oxides and copper compounds, along with traces of other metals that have settled out of the feed water onto the tube sheet. The correlation between sludge levels and tube wall thinning suggests that the sludge deposits provide a situs for concentration of phosphates or other corrosive agents at the tube wall.

Accordingly, it is desirable to remove such sludge deposits periodically and prevent deterioration of the tubes.

One known method for removal of sludge from the tube sheet is the sludge-lance-suction method. This method utilizes high-pressure water to break up and slurry the sludge and also utilizes suction and filtration equipment to remove the water-sludge mixture from the tube sheet. In this known method, a pair of flexible, perforated suction headers are introduced through a six-inch handhole to a position at the periphery of the tube sheet at the peripheral edge of the tube bundle. A multiplicity of small suction openings is provided along the length of each of these suction headers. A jet lance is then introduced through the handhole and is aligned between rows of the tubes. The lance is moved along the tube sheet while two high-velocity water jets are established perpendicular to the movement of the lance. These water jets force the sludge toward the periphery of the tube sheet, where the flexible suction header sucks up the water-sludge mixture.

Experience has shown that this sludge-lance-suction method is not particularly effective. One of the problems with this known method is that an expanded water volume exits the tube bundle near the periphery of the tube sheet and overwelms the capacity of the suction headers. As a result of this, the sludge is redeposited in the wrapper area of the tube sheet or is washed back in amoung the U-tubes. In addition, because the flexible headers need to be provided with an abundance of suction openings, it is difficult or impossible to properly align the holes of the flexible headers with the rows of the tubes on the tube sheet.

In another known method of sludge lancing, high pressure water jets are directed from a fluid lance inserted through a clear passage across the center of the tube sheet toward the periphery through the open passages between rows of the tubes. In this known method, a stream of water is admitted at the periphery of the tube sheet, and is directed so as to flow in a channel circumferentially around the tube sheet in the channel formed between the tubes and the shell, to a removal point also located at the periphery. The high-pressure water jets loosen and entrain the sludge to move the same outward to the peripheral channel. Then, the sludge becomes entrained in the circumferential fluid stream and is theoretically carried away by a suction device at the removal point. In this known method, the jet lance is provided with fluid at as high a pressure as is practicable, using a variable, positive constant-displacement pump, e.g., at 200–10,000 psig, and at as high a flow rate as is practicable. The water to establish the peripheral current is admitted separately through a separate connection at the handhole or through a fixed jet aimed into the space between the tubes and the shell.

Unfortunately, the surge of water emanating from the lance jet adds to the volume in the peripheral current, thereby causing water to pile up ahead of the removal point. This piling up permits sludge particles in suspension to settle out before the suction device at the removal point is reached. Also, the presence of the peripheral fluid current causes the level of fluid to build up on the tube sheet, especially near the periphery thereof. This level of water interferes with the scouring action of the high pressure jet, which is the principal mechanism that removes the sludge from the tube sheet.

In addition, the known methods of removing sludge from the tube sheet rely only upon the impact of a fluid jet and on its continued velocity to loosen sludge particles and to maintain the same in suspension.

OBJECTS AND SUMMARY OF THE INVENTION

Accordingly, it is an object of this invention to provide a method of removing sludge from a steam generator, which methodprovide a method of sludge removal which is simple and reliable as compared with known methods.

According to an aspect of this invention, sludge deposits are removed from a steam generator in which primary heating fluid tubes rise within a peripheral wall of the generator from a substantially horizontally tube sheet, with the tubes being arranged to define passageways therebetween extending from a medial end disposed at a medical clear passage on the tube sheet to a peripheral end thereof disposed at the edge of the tube sheet. A peripheral channel is defined between the outermost tubes on the tube sheet and the peripheral wall.

The method involves inserting a fluid jet lance through a port or handhole in the peripheral wall near the tube sheet at the clear passage to direct a jet of fluid along one of the passageways between the tubes. A flexible fluid suction conduit having a suction opening at the end thereof is positioned through a port in the peripheral wall into the peripheral channel, so that the suction opening is aligned at the peripheral end of the passageway along which the jet of fluid is directed. A cleaning fluid is supplied at high pressure to the jet lance to form the jet of fluid and to dislodge and entrain in the jet of fluid sludge particles from the tube sheet, so that the jet of fluid and the entrained sludge flow toward the suction opening of the fluid suction conduit at the peripheral end of the passageway. Suction is applied to the fluid suction conduit to suck up the fluid and the entrained sludge at the peripheral end of the passageway. Then, after the one passageway is cleaned of sludge, the fluid lance and the suction conduit are moved to align the jet and the suction opening with opposite ends of each of the remaining passageways, until the entire tube sheet has been cleaned of sludge. A suction system associated with the suction conduit has a capacity greater than the rate of flow of fluid from the jet lance, so that the fluid does not pile up ahead of the suction conduit.

Preferably, the fluid which is sucked up by the suction conduit is cleansed of the sludge particles and is recirculated and is returned to the jet lance. This fluid can be a solution of water heated to 150° F. to 180° F. and a cleansing agent, such as a detergent or chelating agent.

Also preferably, the fluid lance can be rotated so that the point of impact of the fluid jet is first directed at the medial end of the passageway, and is then moved gradually toward the peripheral end thereof. The above, and many other objects, features, and advantages of this invention will become apparent from the ensuing description of a preferred embodiment, which is to be considered in connection with the accompanying drawings.

BRIEF DESCRIPTIONS OF THE DRAWINGS

FIG. 3 is a plan view of the tube sheet.

FIG. 4 is a cross-sectional elevation of a typical steam generator near the tube sheet.

DETAILED DESCRIPTION OF A PREFERRED EMBODIMENT

Figure 1:
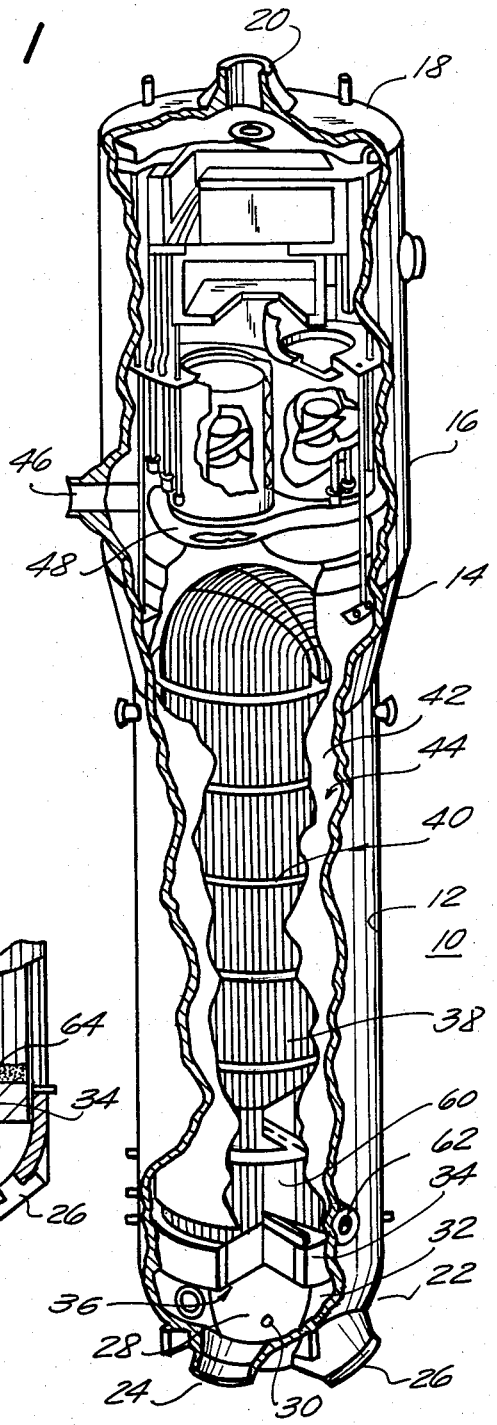
FIG. 1 is a partial cross-sectional elevation of a typical steam generator.
Figure 2:
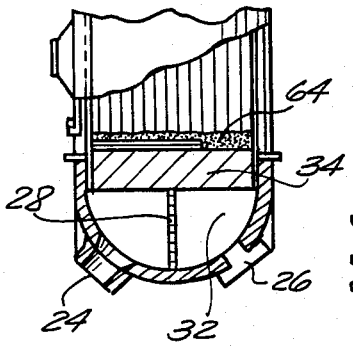
FIG. 2 is a partial cut-away elevation of the typical steam generator showing an accumulation of sludge on the tube sheet thereof.
Figure 5:
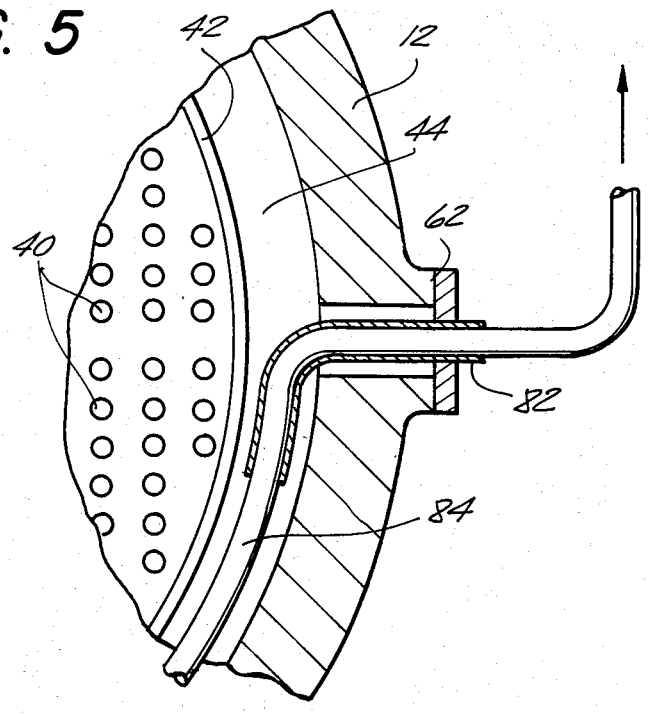
FIGS. 5 and 6 are partial plan and elevational views, respectively, showing the insertion of a tube guide and a flexible suction tube into the peripheral channel of the tube sheet of the steam generator.
Figure 6:
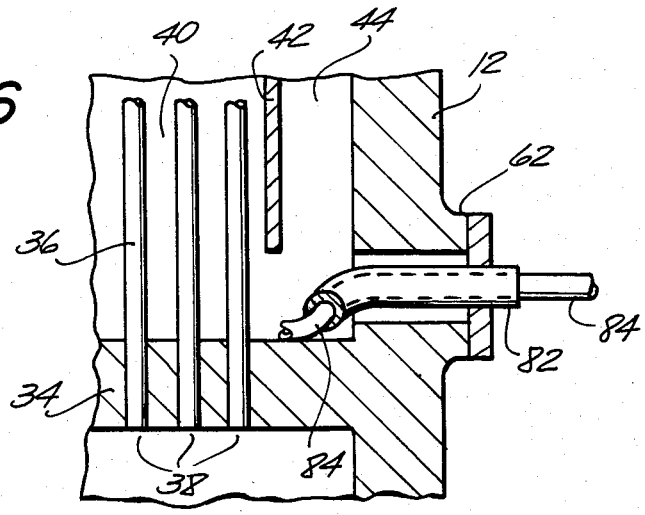

With reference to FIGS. 1 and 2, a nuclear steam generator 10 is formed of a lower shell 12 connected by means of a conical transition shell 14 to an upper shell 16. A convex head 18 having a steam nozzle 20 disposed thereatop encloses the upper shell 16, while a substantially spherical head 22 having inlet and outlet nozzles 24, 26 disposed thereon closes off the lower shell 12. A dividing plate 26 centrally disposed in the head 22 divides the latter into inlet and outlet primary fluid headers 30 and 32.

A substantially horizontal tube sheet 34 has a multiplicity of tube holes 36 therein and is attached to the lower shell 12 and to the spherical head 22 to isolate the inlet and outlet headers 30, 32 from the portion of the steam generator 10 above the tube sheet 34. U-tubes 38 which are heat transfer tubes formed of Inconel or other similar material are disposed in the tube holes 36. Approximately 7,000 of these tubes 38 form a generally U-shaped tube bundle 40. Each tube 38 in the tube bundle 40 is in fluid communication with the inlet header 30 and extends upwardly from the tube sheet 34 to a pipe bend, and then downwardly therefrom to the tube sheet 34 where the tube 38 is in fluid communication with the outlet header 32.

In operation, primary reactor fluid is circulated from the reactor core (not shown) through the inlet nozzle 24, where the fluid flows into the inlet header 30. From there, the primary fluid flows upwardly through the tubes 38 in the tube sheet, through the U-shaped curvature of the tubes 38, and down through the tubes 38 into the outlet header 32. After that, the primary fluid is further cooled in a conventional manner and is cycled back to the reactor.

As further shown in FIGS. 1 and 2, the tube bundle 40 is encircled by a cylindrical wrapper 42 disposed a short distance above the tube sheet 34 into the region of the transition shell 14. This wrapper 42 together with the lower shell 12 forms and annulus 44, and secondary fluid or feed water is supplied through an inlet nozzle 46 disposed on the upper shell 16 to a feedwater header 48 which discharges the feed water to flow down the annulus 44 until the feed water contacts the tube sheet 34. Upon reaching the bottom of the annulus 44 near the tube sheet 34, the feed water is directed inwardly around the tubes 38, where the feed water passes in a heat-transfer relationship with the tubes 34. The hot primary fluid in the tubes 34 transfers its heat through the tubes 38 to the feed water, thereby heating and eventually boiling the feed water to produce steam.

The steam so produced travels upwardly through the upper portion of the generator 10 within the upper shell 16, where any of several well known techniques can be used to remove moisture from the steam. Then, the live steam is supplied through the steam nozzle 20 to a turbine or other steam operated engine for driving electrical generators.

Referring to the lower portion of FIGS. 1 and 2, the bending of the tube bundle 40 results in a straight-line section 60 of the tube sheet 34 that is free of tubes 34. This straight-line section 60 is often referred to as the tube lane. A pair of handholes 62 are provided on opposite sides of the lower shell 12 at a point just above the tube sheet 34 and in line with the tube lane 60. One of such handholes 62 is hidden from view. These handholes 62 permit access to the area of the tube sheet 34 during times that the generator 10 is not in operation. As is shown in FIG. 2, a layer of sludge 64, which usually consists of iron oxides, copper compounds, and other metals, settles out of the feed water onto the tube sheet 34. This is the sludge that causes the tubes 38 to deteriorate, permitting radioactive particles in the primary fluid in the tubes 34 can leak out into the feedwater and steam of the steam generator.

When the reactor is not in operation, i.e., during refueling, the steam generator 10 can be inspected and cleaned. To clean the tube sheet portion of the generator 10, the covers are removed from the handholes 62 for access to the tube lane 60. Then, the apparatus for carrying out the sludge removal technique of this invention can be installed as will now be described with reference to FIGS. 3–7, throughout which the same reference numbers identify the same elements.

A fluid lance 70 formed as an elongated hollow rod having a jet nozzle 72 disposed at its end, is inserted into one of the handholes 62, and is fastened to the handholes 62 by means of a mounting arrangement 74. The lance 70 extends into the tube lane 60 as far as an obstruction at substantially the middle of the tube lane, and is adjusted axially until the jet nozzle 72 is aligned with a passageway 76 defined by two adjacent rows of the tubes 36.

In this embodiment, because the passageways 76 are at right angles to the tube lane 60, the jet nozzle 72 is directed at a right angle to the axis of the lance 70.

In the other handhole 62 there is installed a suction device 80 formed of a guide tube 82 positioned through the handhole 62 and a flexible suction hose 84 guided into a channel at the bottom of the annulus 44 by the guide tube 82. The guide tube 82 permits the hose 84 to be pushed in and pulled back out until an open end 88 of the flexible hose 84 is aligned in the peripheral channel at the peripheral end of the passageway 86.

Then, a cleaning fluid is supplied to the fluid lance 70 under high pressure, so that a jet of the fluid impacts against the sludge 64 on the tube sheet 34. The jet of fluid entrains particles of sludge and these flow along the passageway 76 toward awaiting the suction opening 88 at the end of the passageway 76. At the same time, a suction system applies suction to the hose 84 so that substantially all of the fluid and entrained sludge is sucked up by the hose 84 at the exit end of the passageway 76.

The guide tube 82 ensures that the hose 84 is bent gently as it is led into the channel at the bottom of the annulus 44, so that sharp bends in the hose 84 are avoided, and pressure drop in the hose is as low as possible. The suction system, at the same time, has a capacity greater than the flow of fluid from the lance jet nozzle 72, so that the fluid does not pile up ahead of the suction hose 84. This suction system should be capable of sucking dry when there is insufficient fluid to cover the end 88 of the suction hose. The fluid lance 70 can be rotated about its axis so that the impact point of the jet emanating from the jet nozzle 72 can be directed initially at a point on the passageway near the tube lane 60, and then gradually moved toward the peripheral end of the passageway 76.

When the passageway 76 has been cleaned of sludge, the axial position of the lance 70 can be adjusted, and the hose 84 can be moved into or out of the handhole 62, as necessary, so that the jet nozzle 72 and the open end 88 of the hose 84 are aligned with ends of another passageway 76 to be cleaned of sludge.

This method is repeated for each such tube passageway 76 until the entire tube sheet 34 has been jet scrubbed and cleaned of the sludge deposits.

By moving the suction hose 84 in and out during this process, its open end 88 will move back and forth in the circumferential channel defined by the annulus 44. In this way, the suction hose 84 will pick up any sludge "mud" that may have settled out in the circumferential channel.

With the method of this invention, a circulatory flow around the peripheral of the tube sheet is not used, and the necessity for special equipment for generating such a circumferential flow is avoided.

In an alternative mode, a jet lance 70 having a plurality of jet nozzle 72 along its length can be used, and the suction hose 84 corresponding therewith can have a corresponding number of suction apertures along its length. Such a suction hose 84 would be positioned in the peripheral channel, but not moved. However, such an arrangement is not preferred, as with the large number of suction openings, the hose attains only a sluggish pickup of the cleaning fluid and entrained sludge.

In order to enhance the cleaning action of the technique of the invention and to keep the particles of sludge suspended and entrained in the fluid, it is preferred to use a continuous circulation of a cleaning solution of how water combined with a cleansing agent such as a detergent or chelating agent. The water should be heated to below the boiling point, preferably 150° F. to 180° F. (65°–82° C.). The cleansing agents can be used either singly or in combination. Suitable detergents can be of the anionic, cationic, nonionic, or switterionic type, or of a combination of such types. Suitable chelating agents may be EDTA, NTA, or other suitable chelating agents of the type that are employed for boiler scale removal and industrial cleaning. Combinations of detergents and chelating agents can be effectively used.

Figure 7:
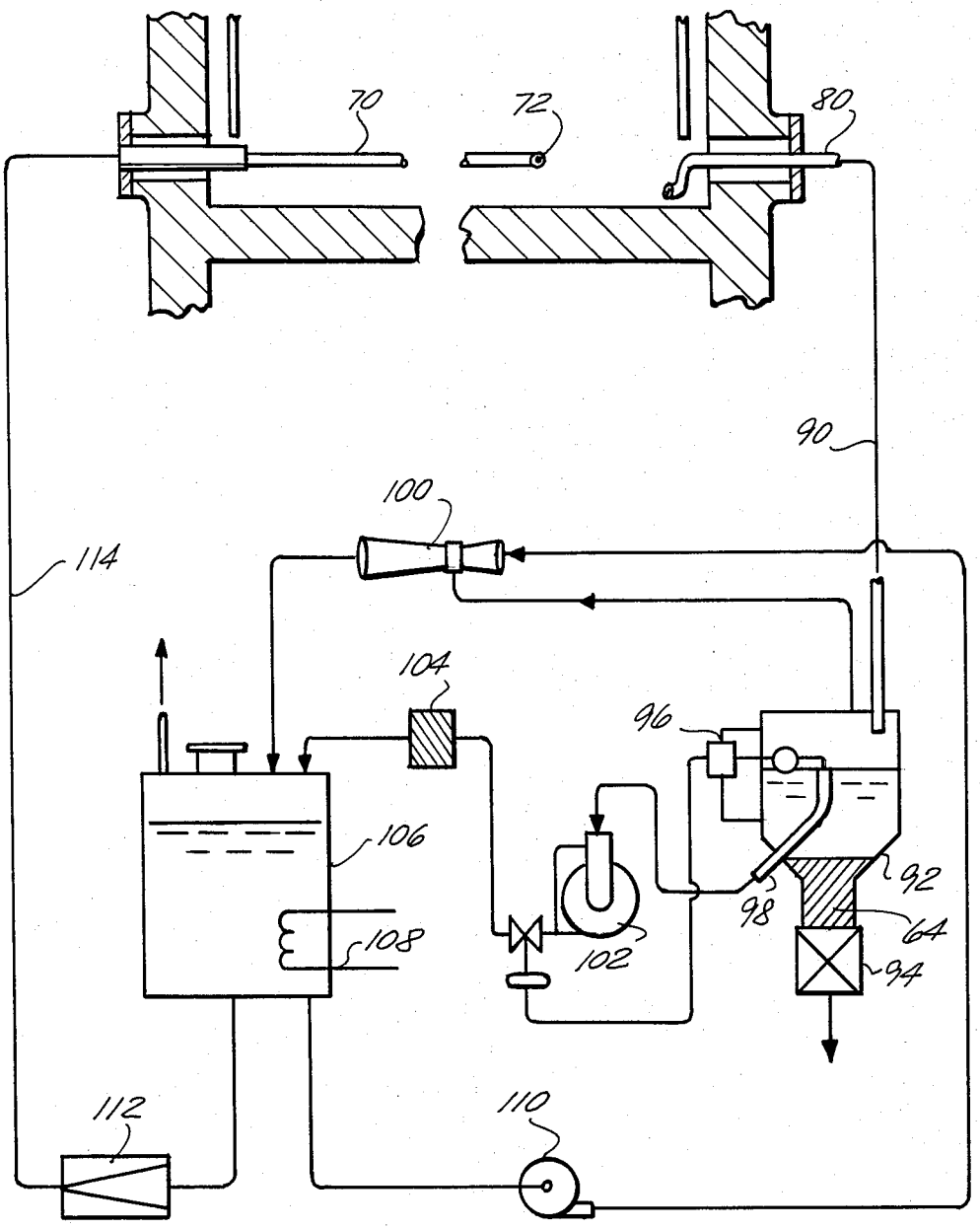
FIG. 7 is a schematic flow diagram of fluid process apparatus used in connection with the method of this invention.

An external cleaning fluid conditioning system for use with this invention is illustrated in FIG. 7. Here, the fluid is sucked from the suction arrangement 80 through a suction line 90 into a collection chamber 92 in which the sludge 64 is permitted to settle. Then, the sludge is removed by a sludge processing device 94 at the bottom of the chamber 92. A level control 96 permits the fluid in the chamber 92 to be siphoned through a conduit 98 when the level of fluid exceeds a predetermined amount.

An eductor 100 produces vacuum and is coupled to the chamber 92 to reduce the pressure thereof. The fluid is suppled through the conduit 98 and a self-priming impellor pump 102 and fine filter 104 into a cleansing fluid holding tank 106 which is provided with an electric tank heater 108. A connecting line 110 connects the holding tank 106 with one end of the eductor 100, and another end of the eductor is connected to the tank 106.

Cleansing fluid from the tank 106 is pressurized by a high pressure pump 112 and is fed through a supply line 114 to the fluid lance 70.

In addition to the above described method, the present invention can be carried out in many other ways. One alternative method for accomplishing the purposes of this invention is to supply high pressure steam to the lance 70. Then, either simultaneously or alternately with the steam lancing, fluid lancing could be used to flush the sludge particles to the open end 88 of the hose 84.

Another variation of this method involves initially flooding the tube plate with fluorochloromethane (Freon) and then supplying steam to the tubes 38 to heat the tube plate 34. This causes the fluorochloromethane to boil violently, thereby disrupting the particles of sludge. Then, the fluorochloromethane can be removed, and the steps of the method as set forth above can be carried out.

Many further modifications and variations of this invention can be carried out by those of ordinary skill in the art without departure from the scope and spirit of this invention, as defined in the dependent claims.

What is claimed is:

1. A method of removing sludge deposits from a steam generator in which primary heating fluid tubes rise within a peripheral wall of said generator from a substantially horizontal tube sheet, with the tubes being arranged to define passageways therebetween extending from a medial end thereof at a medial portion of the tube sheet to a peripheral end thereof at an edge of said tube sheet, and with a peripheral channel being defined between outermost tubes on said tube sheet and said peripheral wall; comprising:

inserting a fluid jet lance through a port in said peripheral wall near said tube sheet at said medial portion thereof to direct a jet of fluid along one of said passageways between said tubes;

positioning a fluid suction conduit through a port in said peripheral wall into said peripheral channel so that a suction opening of said fluid suction conduit is aligned at the peripheral end of the one passageway along which the jet of fluid is directed;

supplying fluid to said fluid jet lance to form said jet of fluid, and dislodge and entrain sludge on said tube sheet in said jet of fluid, so that the jet of fluid and the entrained sludge flow toward the suction opening of said fluid suction conduit at said peripheral end of said one passageway; and applying sufficient suction to said fluid suction conduit to suck up the fluid and entrained sludge at the peripheral end of said one passageway.

2. A method of removing sludge deposits according to claim 1, further comprising following cleaning of said one passageway, moving said jet lance to align the same to direct said jet of fluid along another of said passageways; aligning said suction opening of said suction conduit with said other passageway; and repeating the steps of supplying fluid to said jet lance and applying suction to said suction conduit.

3. A method of removing sludge deposits according to claim 1; wherein said suction conduit is provided with a suction capacity greater than the rate of flow of said fluid from said jet lance.

4. A method of removing sludge deposits according to claim 1; wherein said suction conduit is in the form of a flexible hose, and said step of positioning the fluid suction conduit includes positioning a guide tube in said one port, and passing the flexible hose within and through said guide tube until an open end of the flexible hose is disposed in said peripheral channel at said peripheral end of said one passageway.

5. A method of removing sludge deposits according to claim 1; wherein said jet lance is insertable in an axial direction thereof into said steam generator and develops said jet of fluid in a radial direction thereof; and said step of supplying fluid to dislodge and entrain said sludge includes rotating said jet lance so that said jet of fluid has an impact point on aid tube sheet that moves from the medial end of said one passageway to the peripheral end thereof.

6. A method of removing sludge deposits according to claim 1; wherein said fluid supplied to said fluid jet lance includes hot water and a cleansing agent.

7. A method of removing sludge deposits according to claim 5; wherein said cleansing agent is a chelating agent.

8. A method of removing sludge deposits according to claim 1; wherein said hot water is provided at a temperature of 150°–180° F. (65°–82° C.).

9. A method of removing sludge deposits according to claim 1; wherein the fluid sucked up by said suction conduit is recirculated back to said jet lance, the method further comprising processing the sucked-up fluid in a collection chamber in which the sludge is precipitated from the fluid; filtering the fluid from which the sludge has been precipitated; feeding the filtered fluid into a supply tank; and pressure-pumping the fluid from the tank to said fluid jet lance.

10. A method of removing sludge deposits according to claim 1; wherein said jet lance has a jet only at its end, and said suction conduit has a single opening at the end thereof.

11. A method of removing sludge deposits from a steam generator in which primary heating fluid tubes rise within a peripheral wall of said generator from a substantially horizontal tube sheet, with the tubes being arranged in rows to define passageways therebetween each having a medial end at a medial clear passage extending diametrically across said tube sheet and a peripheral end at an edge of said tube sheet, and with a peripheral channel being defined between outermost tubes on said tube sheet and said peripheral wall; comprising;

inserting a fluid jet lance through a port in said peripheral wall near said tube sheet into said clear passage, said jet lance having a jet nozzle at its end to direct a jet of fluid along one of said passageways between rows of said tubes;

aligning said jet nozzle with said one of said passageways;

positioning a flexible fluid suction conduit through a port in said peripheral wall into said peripheral channel;

aligning a suction opening at an end of said fluid suction conduit with the peripheral end of said one passageway;

supplying fluid to said fluid jet lance to form said jet of fluid and to dislodge and entrain sludge on said tube sheet in said jet of fluid, so that the jet of fluid and the entrained sludge flows toward the suction opening of said fluid suction conduit at said peripheral end of said one passageway;

applying to said fluid suction conduit suction of greater capacity than the flow of fluid to said jet lance so as to suck up and carry away the fluid and entrained sludge at the peripheral end of said one passageway;

aligning the nozzle of said jet lance with another of said passageways;

aligning said suction opening of said suction conduit with the peripheral end of said other passageway; and repeating the steps of supplying fluid to said jet lance and applying suction to said suction conduit.

12. A method of removing sludge deposits according to claim 11; wherein said fluid is constituted by water heated to at least 150° F. but below the boiling point thereof, and a cleansing agent.

13. A method of removing sludge deposits according to claim 12; wherein said cleansing agent is a chelating agent.

14. A method of removing sludge deposits according to claim 11; wherein the sucked-up fluid is processed by precipitating and removing the entrained sludge, filtering the fluid, and recirculating the filtered fluid back to the jet lance.

* * * * *